United States Patent [19]

Nagata

[11] Patent Number: 4,616,475

[45] Date of Patent: Oct. 14, 1986

[54] PACKAGE FORMING APPARATUS

[75] Inventor: Tomizou Nagata, Tokyo, Japan

[73] Assignee: The Japan Tobacco & Salt Public Corporation, Tokyo, Japan

[21] Appl. No.: 706,335

[22] Filed: Feb. 27, 1985

[30] Foreign Application Priority Data

May 22, 1984 [JP] Japan ..... 59-101729

[51] Int. Cl.[4] ..... B65B 19/24

[52] U.S. Cl. ..... 53/575; 53/234; 493/164; 493/247

[58] Field of Search ..... 53/234, 575; 493/164, 493/472, 247

[56] References Cited

U.S. PATENT DOCUMENTS

| | | | |
|---|---|---|---|
| 1,885,893 | 11/1932 | Bronander . | |
| 2,512,922 | 6/1950 | Dearsley | 53/234 X |
| 2,821,054 | 1/1958 | Ritscher | 493/247 X |
| 3,545,172 | 12/1970 | Osterdahl | 53/234 X |
| 3,978,639 | 9/1976 | Ferrozzi | 493/164 X |
| 4,279,608 | 7/1981 | Evers | 493/472 X |
| 4,391,083 | 1/1983 | Fox | 493/164 X |

FOREIGN PATENT DOCUMENTS

| | | | |
|---|---|---|---|
| 135388 | 3/1985 | European Pat. Off. . | |
| 2032184 | 2/1971 | Fed. Rep. of Germany . | |
| 539836 | 2/1956 | Italy | 493/164 |
| 1306676 | 2/1973 | United Kingdom . | |

*Primary Examiner*—James F. Coan

*Attorney, Agent, or Firm*—Schwartz, Jeffery, Schwaab, Mack, Blumenthal & Evans

[57] ABSTRACT

A package forming apparatus comprises a pushing member which is capable of being inserted into a core member to form the bottom of a package by folding an end portion of the sheet material wound on the core member is driven by a driving mechanism. The driving mechanism comprises a slidable shaft provided on a rotary drum for movement in axial direction thereof, an arm member having one end secured to one end of the sliding shaft, a socket member having an intermediate portion rotatably supported at the other end of the arm member, a crank arm having one end secured to one end of the socket, the other end of the extension shaft being secured to the other end of the socket member and coupling member for snap coupling together the arm member and crank arm at a predetermined rotational position. Thus, the pushing member may be movable between the position where it faces with the core member and the position where it does not face the same.

6 Claims, 9 Drawing Figures

PACKAGE FORMING APPARATUS

CROSS-REFERENCE TO RELATED APPLICATION

This invention relates to an application of U.S. Ser. No. 648,839 of the same applicant, which was filed on Sept. 10, 1984.

BACKGROUND OF THE INVENTION

This invention relates to an apparatus for forming a package suitable for containing, particularly, cigarettes.

In general, a bundle of, for example, 20 cigarettes is housed in a bag-like package or container formed of a sheet material such as an aluminum foil. In forming the package, a rectangular cylindrical core member called arbor is wound with the sheet material. As a result, the body portion of a parallelepiped bag-like package made of the sheet material is formed. Then, one end portion of the sheet material is folded onto one edge surface of the core member so as to form the bottom portion of the package. A bundle of cigarettes arranged in a prescribed fashion is inserted into the package through the open end thereof.

In the apparatus for forming the package, a pushing member for supporting the folded end portion of the sheet material is provided within the arbor. It is necessary for the pushing member to be movable in the longitudinal direction of the arbor. It follows that the apparatus must be made longer so as to permit the movement of the pushing member. To form a plurality of packages at a time, it is considable to provide a plurality of arbors in a circumferential direction. In this case, however, the whole device is rendered bulky.

SUMMARY OF THE INVENTION

An object of the invention is to provide a package forming apparatus, which may prevent the apparatus to become large even if a plurality of pushing members are arranged in an axial direction of a rotary drum for a mass production.

In a package forming apparatus according to the present invention, a pushing member or pushing plate which is capable of being inserted into a core member to form the bottom of a package by folding an end portion of the sheet material wound on the core member in cooperation with bottom folding means is driven by such a driving mechanism as described above.

The driving mechanism comprises a slidable shaft provided on a rotary drum like member for movement in axial direction thereof, an arm member having one end secured to one end of the sliding shaft, a socket member having an intermediate portion rotatably supported at the other end of the arm member, a crank arm having one end secured to one end of the socket, the other end of the extension shaft being secured to the other end of the socket member and coupling means for snap coupling together the arm member and crank arm at a predetermined rotational position.

Thus, the pushing member may be movable between the position where it faces with the core member and the position where it does not face the same. Thereby enabling to set the movable region of the pushing member in a large latitude to small the apparatus.

Further, a large number of packages may be formed simultaneously by, for example, arranging two rows of core members to be movable in a longitudinal direction so as to make the relative positions of the core members changeable. The core members thus arranged are moved to form the body portion of the package. In this method, the lateral movement of the core members is not obstructed by the pushing rod. Thus, a mass production of the packages may be achieved without enlarging the diameter of the whole device.

DETAILED DESCRIPTION OF THE PREFERRED EMBODIMENT

The invention will now be described with reference to the drawings.

Figure 4:
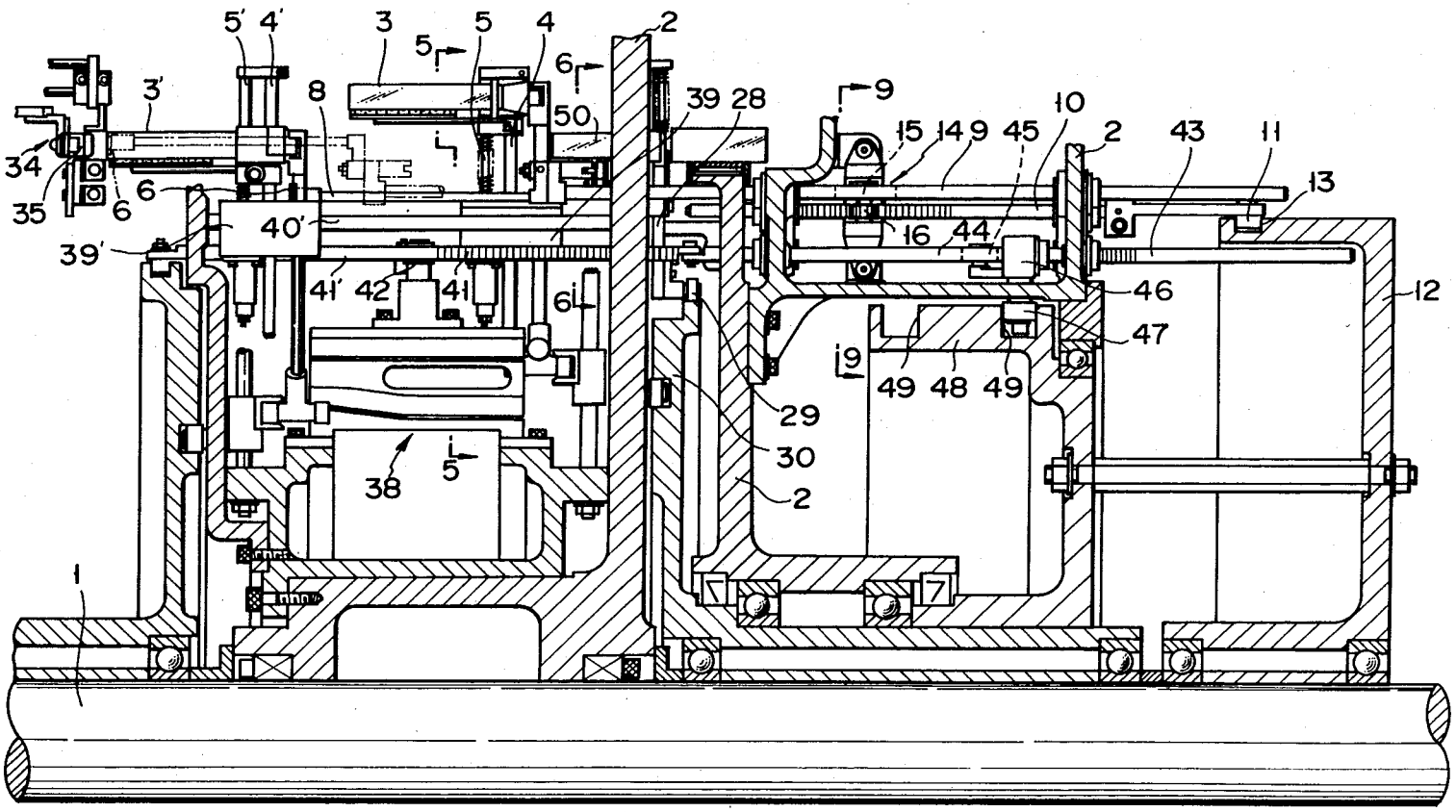
FIG. 4 is a sectional view showing the half of the package forming apparatus.

Referring to FIG. 4, a portion of the packing machine is shown in a section taken along a shaft 1 with a symmetrical other half with respect to the axis of the shaft 1 being omitted. A rotary drum-like base 2 is secured to the shaft 1 for rotation in unison therewith. The base 2 supports cylindrical core members 3 and 3' and package forming means. The shaft 1 is rotatably supported in a rotationary body. The stationary body has a drum-like or disk-like portion, and a groove cam or a face cam is provided on the peripheral surface or a side surface of the stationary drum-like or disk-like portion. The cam is coupled to a cam follower for driving the package forming means provided on said rotary drum-like base 2.

In FIG. 4, only a single cylindrical core member 3 and a single cylindrical core member 3' are shown, but actually a plurality of, preferably 24, core members 3 and the same number of core members 3' are provided around the shaft 1 such that they are movable in the direction of shafts 4 and 5 or 4' and 5'. The core members 3 revolve about the shaft 1, and as they revolve, aluminum coil sheets are supplied to and wound on them. The core members 3' also revolve around the shaft 1, and as they revolve packing sheets are wound on the aluminum foil sheets that have been wound on the core members 3. As can be inferred from the above, the core members 3 and 3' act as pairs, so that their illustrated positions can be substantially interchanged, but the interchange of positions that takes place as the core members are revolving is not described in detail. However, both the core members 3 and 3' receive operations of winding and folding sheets, so that during their revolution their distance from the axis of rotation, i.e., height, is varied with their movement along the shafts 4, 5 and 4', 5'.

FIG. 4, shows that the core member 3' is wound with the aluminum foil and packing sheet and the bottom of the package is folded with inserting a pushing member 6 for receiving the bottom. The core member 3' is shown at the lowest level position in its range of movement along the shafts 4' and 5', while the other core member 3 is shown at an intermediate level position in its range of movement along the shafts 4 and 5.

Figure 1:
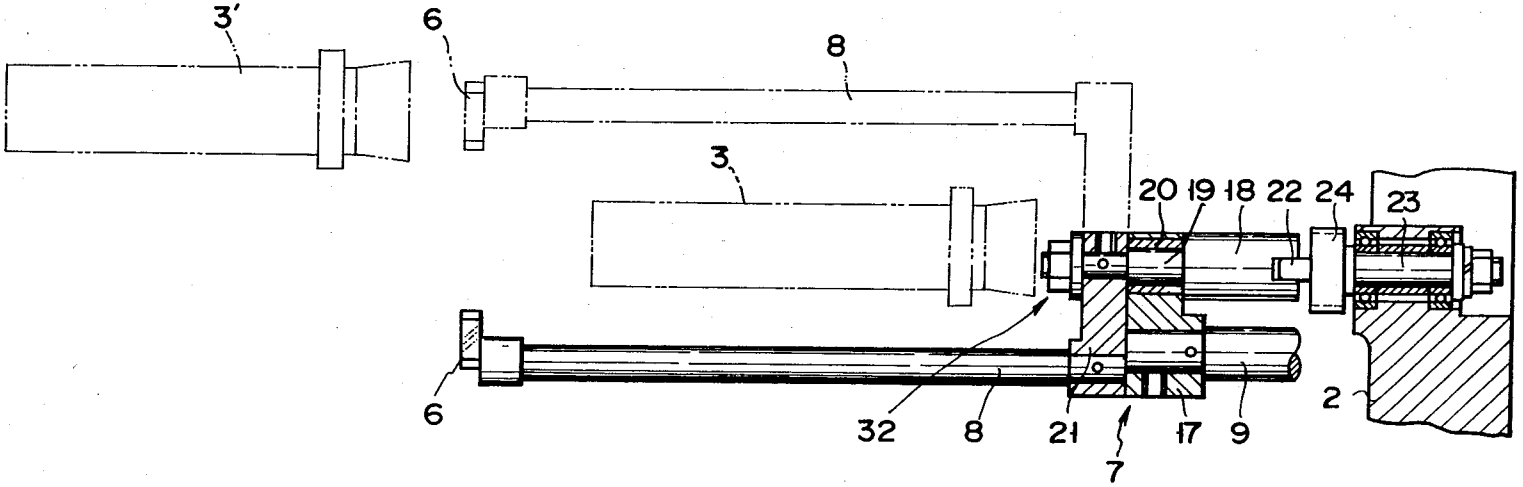
FIGS. 1 and 2 are sectional views taken in different directions showing an inverting connecting section for connecting an extension shaft and a sliding shaft in an embodiment of a package forming apparatus according to the invention.

A package bottom receiving clamp unit has an extension shaft 8 and a slidable shaft 9, as shown in FIG. 1, these shafts being connected together at one end by an inverting connecting section 7. It is supported as an integrated assembly on the rotary drum-like base 2 for movement in the axial directions.

The pushing member 6 is secured to the other end of the extension shaft 8. It has a plate-like shape corresponding to the sectional profile of a bore formed in the cylindrical core member 3', and is capable of being inserted into the bore. A rack shaft 10 extends parallel to the slidable shaft 9, and is supported on the rotary drum-like base 2 for axial movement. It carries a cam follower 11 provided at an end. The cam follower 11 is engaged in a cam groove 13 which is provided on the periphery of a stationary drum 12.

Figure 9:
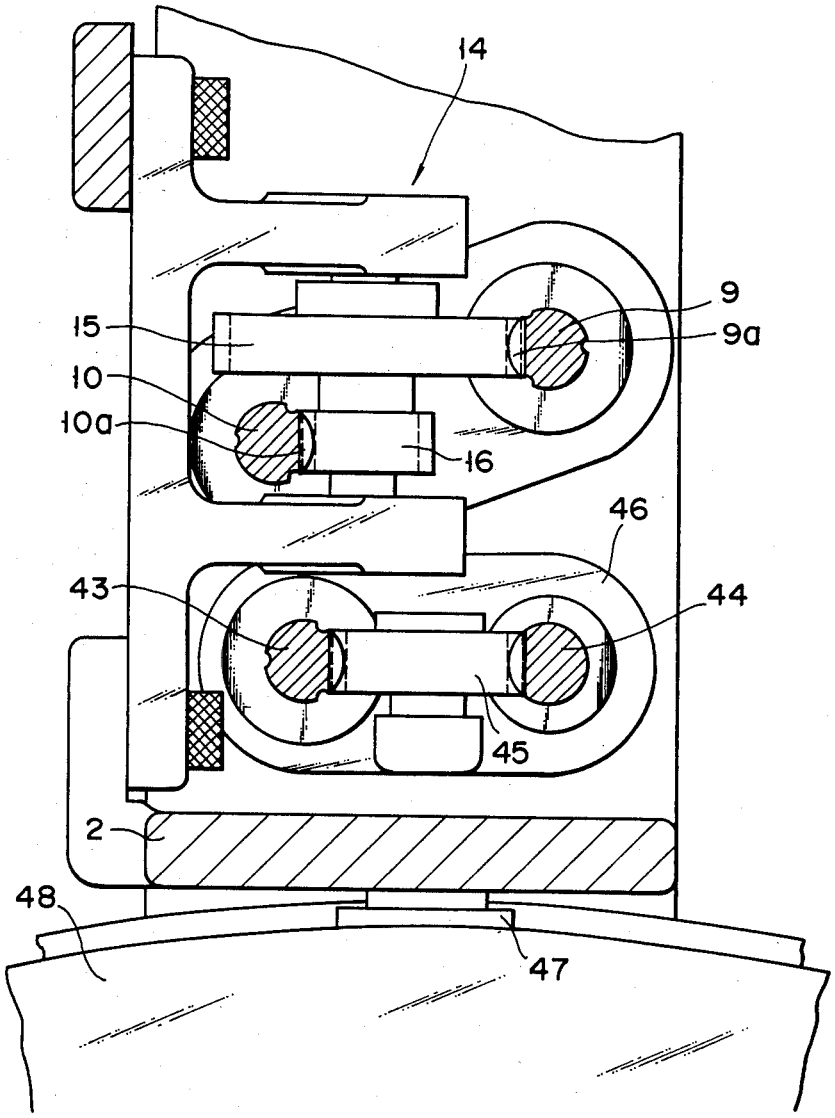
FIG. 9 is a sectional view taken along line 9—9 in FIG. 4.

As shown in FIG. 9, the slidable shaft 9 and rack shaft 10 have respective racks 9*a* and 10*a* provided on their sides facing each other. Between the two racks is provided a pinion member 14, which is rotatably supported on the rotary drum-like member 2. The pinion member 14 has a large diameter pinion 15 and a small diameter pinion 16, these pinions being coaxial and integral with each other. The large diameter pinion 15 is in mesh with the slidable shaft rack 9*a*, and the small diameter pinion 16 is in mesh with the rack shaft rack 10*a*. These pinions transmit motion of a magnification factor corresponding to a suitably set gear ratio.

Figure 2:
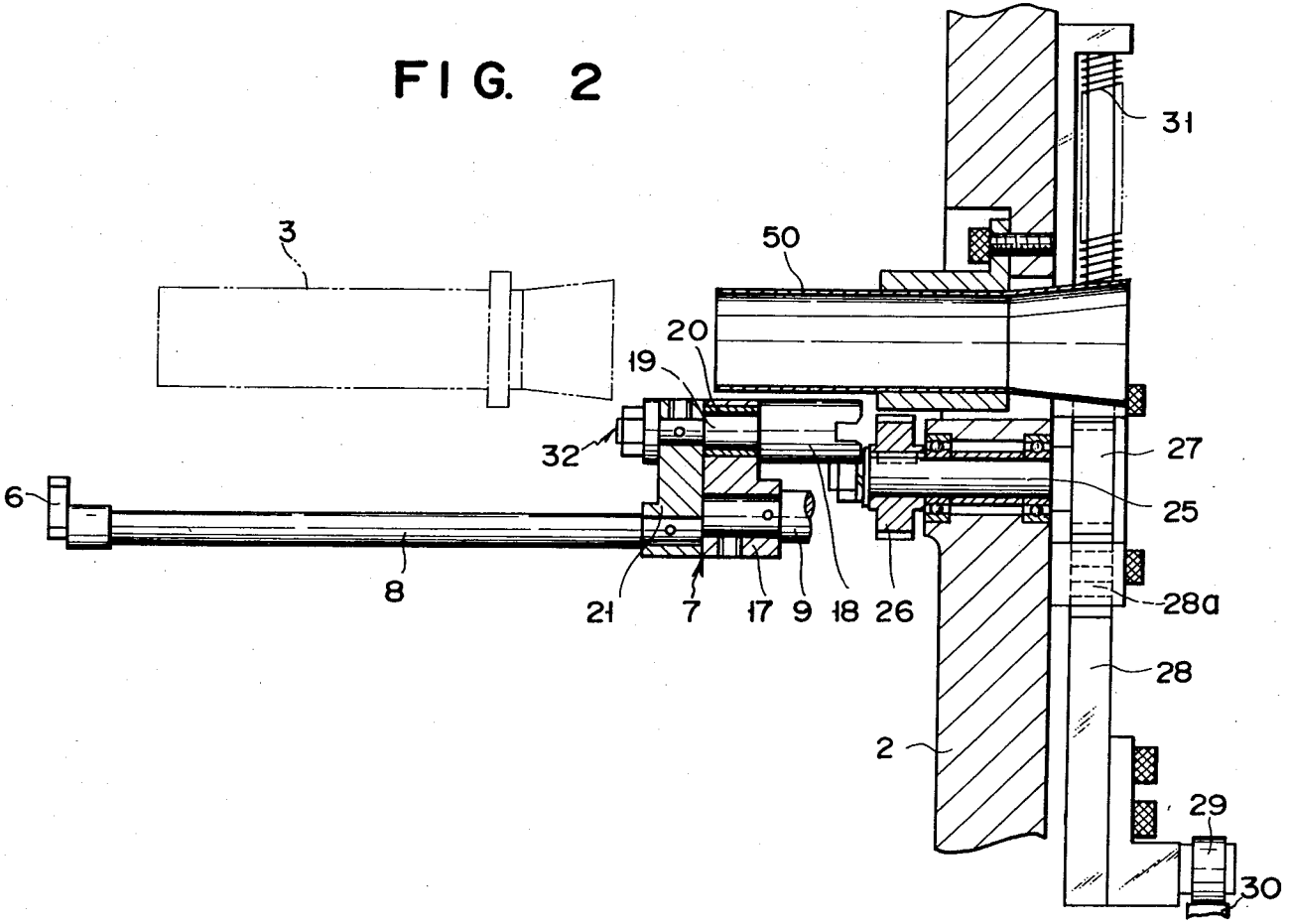

The inverting connecting section 7 will now be described in detail with reference to FIGS. 1, 2 and 7.

An arm member 17 extending perpendicular to the sliding shaft 9 is secured at one end to an end of the sliding shaft 9. It has a socket member 18 provided at the other end. A shaft 19 extending from an end of the socket member 18 is rotatably supported in a bush 20 provided in the arm member 17. A small diameter end portion of the shaft 19 is secured to an end of a crank arm 21.

The extension shaft 8 is secured at one end to the other end of the crank arm 21. The pushing member 6 is secured to the other end of the extension shaft 8 as mentioned before.

The socket member 18 has a female engaging portion formed at its head and faces a plug member 22 which is a male engaging member to be coupled to the female engaging portion. The plug member 22 is provided at an end of a shaft 23.

The shaft 23 is rotatably supported in the rotary drum-like base 2 and has an integral gear 24. A gear shaft 25 which has an integral gear 26 meshing with the gear 24 is rotatably supported in the rotary drum-like base 2, and it has an integral pinion 27 provided at the other end.

A rack lever 28 with a rack 28*a* in mesh with the pinion 27 is slidably supported on the rotary drum-like base 2 for movement in radial direction of the shaft 1. The rack lever 28 has a cam follower 29 provided at an end. The cam follower 29 is in engagement with and driven by a stationary disk cam 30. This cam engagement is held by a return spring 31, which urges the rack lever 28 against the cam 30.

Figure 7:
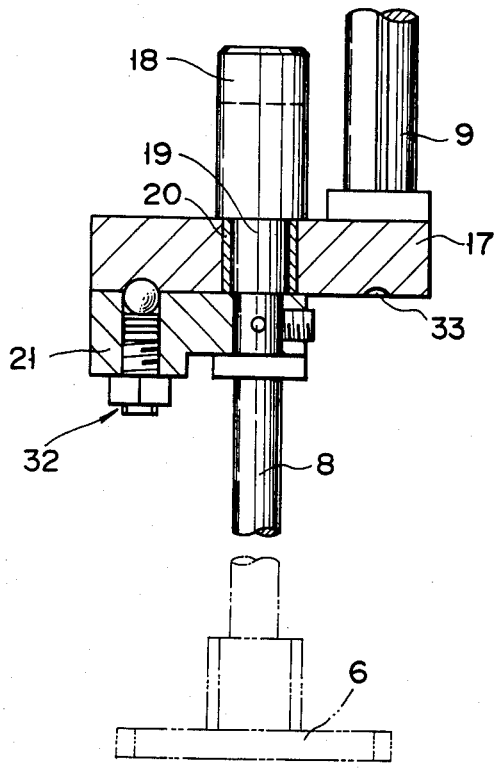
FIG. 7 is a sectional view taken along line 7—7 in FIG. 5.
Figure 8:
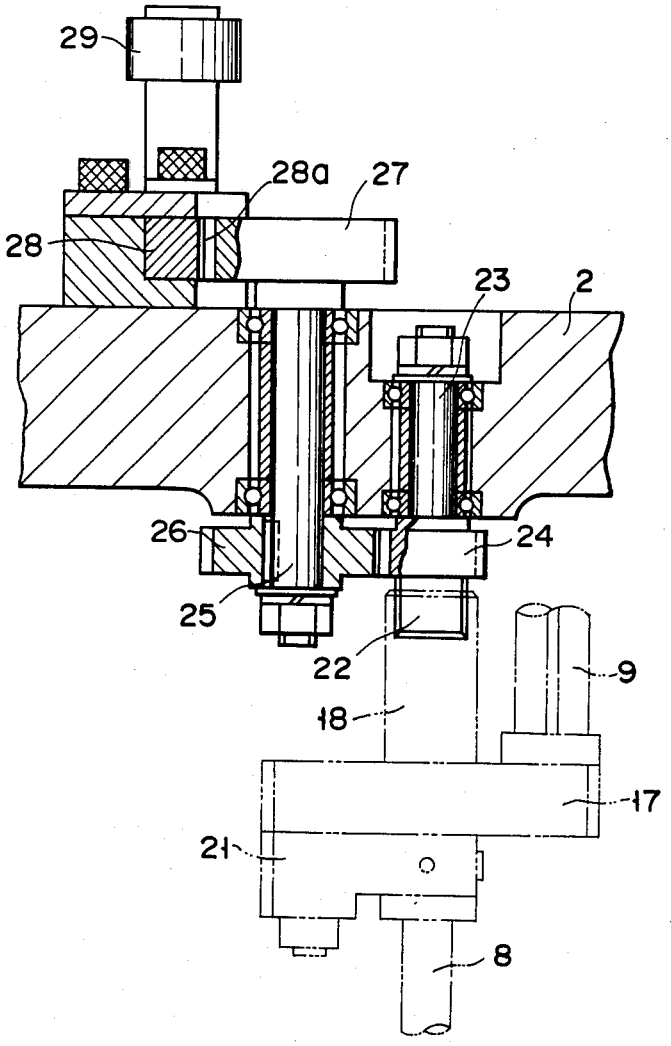
FIG. 8 is a sectional view taken along line 8—8 in FIG. 6.

The crank arm 21, as shown in FIG. 7, has a snap member 32 which is screwed to and elastically held by the crank arm 21 such that it can engage with the arm member 17 at a predetermined relative rotational position. The snap member 32 has a ball which elastically projects toward the arm member 17. The ball is capable of being engaged in recesses 33 formed in the arm member 17.

Figure 3:
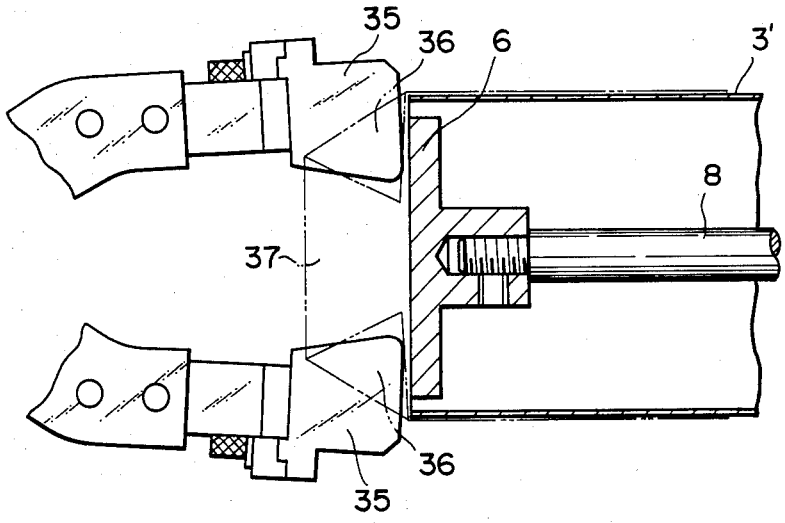
FIG. 3 is a sectional view showing a bottom folding unit.

The pushing member 6 which is secured to the end of the extension shaft 8 is inserted into the bore of the cylindrical core member 3' at the position of operation of folding the bottom of a package toward the outer end of the bore. The core member 3' at the operating position noted above faces a bottom folding unit 34. An edge of packing sheet is folded along the end surface of the core member 3'. First, ear flaps 36 are folded by a pair of ear folding pawls 35 (see FIG. 3), and then upper and lower bottom flaps 37 are folded. During these folding operations, the pushing member 6 is found at the end face of the core member 3' and supporting the sheet being folded from the inner side.

Figure 5:
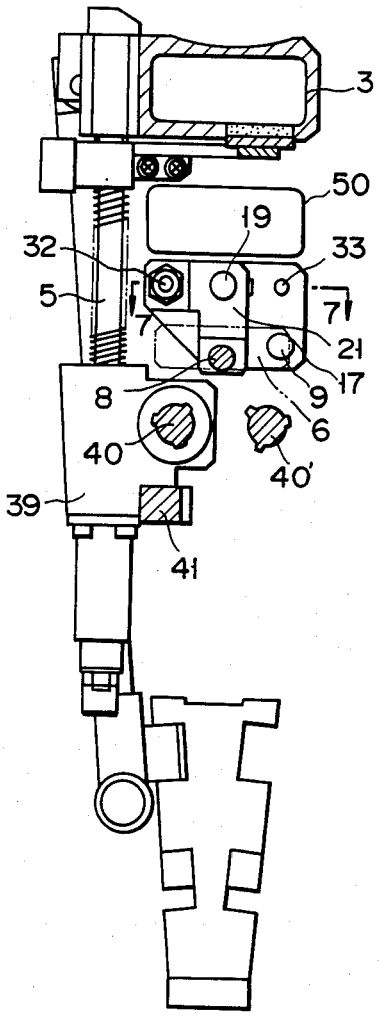
FIG. 5 is a sectional view taken along line 5—5 in FIG. 4.
Figure 6:
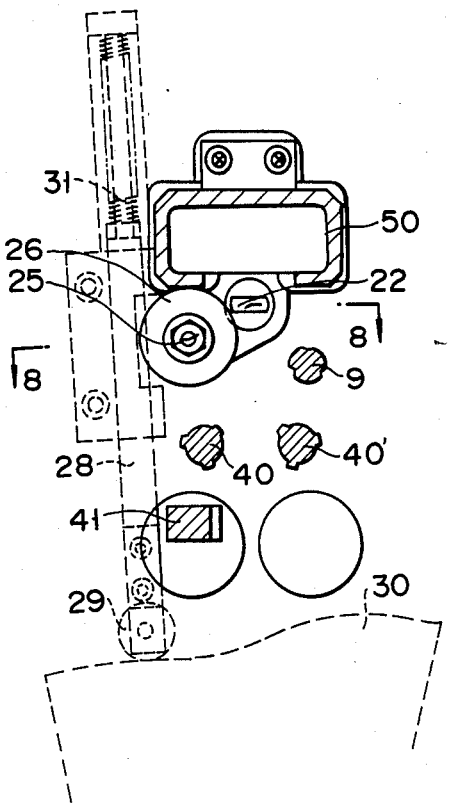
FIG. 6 is a sectional view taken along line 6—6 in FIG. 4.

The operation of the apparatus having the above construction will now be described. As each cylindrical core member 3 mounted on the rotary drum-like base 2 rotating with the shaft 1 is moved vertically along the shafts 4 and 5, an aluminum foil sheet is supplied to and wound on the core member 3 by sheet winding means (not shown). As the other cylindrical core member 3' is also moved vertically along the shafts 4' and 5', a packing sheet is supplied to and wound on the core member 3', on which the aluminum foil sheet has already been wound, by sheet winding means (not shown), and bottom folding is done by the bottom folding unit 34 partly shown. The positions of the core members 3 and 3', i.e., their rotary rows formed around the shaft 1, are interchanged by core interchanging means 38, although this is not described in detail. FIG. 5 shows part of the interchanging means 38. As is shown, a sliding member 39 which supports the shaft 5 supporting the core member 3, is slidable along a splined shaft 40. The core member 3' is similarly slidable along a splined shaft 40' via a sliding member 29'. A pinion 42 is provided between racks 41 and 41' integral with respective sliding members 39 and 39'. A rack shaft 43 extending from the rack 41 is slidably supported on the rotary drum-like base 2, and a pinion 45 is provided between it and a facing rack shaft 44, as shown in FIG. 9.

The rack shaft 44 is fixdly provided on the drum-like base 2 and a sliding block 46 is provided slidably along the rack shaft 44. The rack shaft 43 penetrates the other shaft hole formed in the sliding block 46 which is supported by both the rack shafts 43 and 44. The sliding block 46 supports the pinion 45 at one end and a cam follower 47 at the other end. The cam follower 47 is engaged in a groove cam 49 provided on the outer periphery of a stationary drum 48, permitting relative movement of the sliding members 39 and 39'. The cylindrical core member 3' which carries a package container obtained after the bottom folding operation is displaced from the left to the right in the Figure by the interchanging means 38 and comes a position facing a cigarette guide opening 50 provided in the rotary drum-like base 2. A bundle of cigarettes corresponding to one box are discharged through the cigarette guide opening 50 and inserted into the bore of the cylindrical core member 3 by cigarette inserting means (not shown).

The inserted cigarette bundle is further pushed in a subsequent step, whereby a package container accommodating the cigarettes is pushed out from the core member 3.

In a step of bottom folding of the package container on the outer end of the cylindrical core member 3', the pushing member 6 is found in the core member 3', while in the other steps it is found on the outer side of the inner end of the core member 3'. The extension shaft 8 thus has a length greater than the length of the core member 3'. The inverting connecting section 7 is arranged such that the extension shaft 8 retreats to the operating zone of the other core member 3 when the pushing member 6 is withdrawn from the core member 3'.

The sliding shaft 9 that extends through the inverting connecting section 7 in the other direction is axially moved through the cam follower 11. The insertion and withdrawal of the pushing member 6 into and out of the core member 3' take place after the cam follower 11.

When the pushing member 6 is outside the core member 3', the extension shaft 8 has been retreated from the operating zone of the core member 3 and at a low level position. At this time, the assembly of the inverting connecting section 7 is at the rightmost end. In this case, the socket member 18 secured to the crank arm 21 is abutting with the shaft 23, and the plug member 22 is inserted in and connected to the socket member 18.

When the rack lever 28 is driven by the stationary disk cam 30, the socket member 18 is driven through the pinion 27 and gears 26 and 24 to drive the crank arm 21. When the extension shaft 8 is at the initial low level position and is driven to a high level position, the crank arm 21 is held in position by the snap member 32. A displacement, however, is given to the stationary disk cam 30 by the positional relation noted above.

The extension shaft 8 that has been inverted to the high level position, is driven to the left through the cam follower 11 provided on the extension shaft 9. The high level position is set such that it is enough for the inversion of the pushing plate 6 into the core member 3'. With the inversion of the pushing member 6 into the core member 3', the socket member 18 is separated from the shaft 23. When the pushing member 6 is withdrawn from the core member 3', the socket member 18 is engaged with the shaft 23. Then it is driven by the rack lever 28 engaged with the stationary disk cam 30, so that the extension shaft 8 is displaced to the low level position through the pinion 27 and gears 26 and 24.

As has been described above, according to the invention the pushing member is provided at the end of the bore of the cylindrical core member to fold the edge of the sheets wound on the core member. Thus, it is possible to reliably provide a given shape and form a neat package. In addition, in order to provide a wide operating zone of the core members arranged in tandem the pushing member driving means is constructed such that it is retractable. It is thus possible to minimize the outer diameter of the package forming unit in the form of a rotary drum and provide for effective arrangement of the operating space of the core members.

What is claimed is:

1. A package forming apparatus comprising:

a shaft;

a stationary body for rotatably supporting said shaft;

a rotary drum-like member provided on said shaft for rotation in unison therewith;

a plurality of cylindrical core members provided on said rotary drum-like member for movement in axial and radial directions, sheet material being wound on the outer periphery of said cylindrical core members, said core members being grouped into first and second groups spaced apart from each other in the axial direction of the shaft;

an extension shaft provided on said rotary drum-like member for movement in the axial direction;

a pushing member provided at one end of said extension shaft and capable of being inserted into the core member;

bottom folding means for forming the bottom of a package by folding an end portion of the sheet material wound on said core member in co-operation with said pushing member inserted into said core member;

a sliding shaft provided on said rotary drum-like member for movement in the axial direction;

first driving means for moving said sliding shaft in the axial directions;

an arm member having one end secured to one end of said sliding shaft;

a socket member having an intermediate portion rotatably supported at the other end of said arm member;

second driving means provided for engagement and disengagement with respect to said rotary drum-like member and rotating said socket member when in engagement therewith;

a crank arm having one end secured to one end of said socket member, the other end of said extension shaft being secured to the other end of said socket member;

coupling means for snap coupling together said arm member and crank arm at a predetermined rotational positon; and means for moving the core members of the first and second groups in the axial direction of the shaft to change the positions of the core members to each other.

2. The package forming apparatus according to claim 1, wherein said first driving means includes means for converting the rotation of said rotary drum-like member to an axial linear motion of said sliding shaft.

3. The package forming apparatus according to claim 2, wherein said first driving means includes a cam follower movably provided on said rotary drum-like member, a cam groove engaged by said cam follower to cause movement thereof in the axial direction of said sliding shaft with the torque of said rotary drum-like member, and transmitting means for transmitting the movement of said cam follower to said sliding shaft.

4. The package forming apparatus according to claim 3, wherein said transmitting means includes a rack shaft provided on said rotary drum-like member, extending parallel to said sliding shaft, movable in the axial direction and supporting said cam follower at one end, and a pinion member meshing with both said rack shaft and a rack of said sliding shaft.

5. The package forming apparatus according to claim 1, wherein said socket member and sliding shaft extend parallel to and in the opposite direction to said extension shaft.

6. The package forming apparatus according to claim 1, wherein said second driving means has a shaft rotatably supported on and rotated with rotation of said rotary drum-like member and transmitting the torque of said rotary drum-like member to said socket member for rotating said socket member when in engagement with said socket member.

* * * * *